US008115647B2

(12) United States Patent
He et al.

(10) Patent No.: US 8,115,647 B2
(45) Date of Patent: Feb. 14, 2012

(54) REDUCING HDD FAILURE CAUSED BY ELECTROMAGNETIC INTERFERENCE FROM WIRELESS DEVICES

(75) Inventors: Hanxiang He, ShenZhen (SG); Na Li, Hougang (SG); Shaoyong Liu, Singapore (SG); Binil Prakash, Tampines (SG)

(73) Assignee: Hitachi Global Storage Technologies, Netherlands B.V., Amsterdam (NL)

( * ) Notice: Subject to any disclaimer, the term of this patent is extended or adjusted under 35 U.S.C. 154(b) by 358 days.

(21) Appl. No.: 12/198,812

(22) Filed: Aug. 26, 2008

(65) Prior Publication Data

US 2010/0052923 A1 Mar. 4, 2010

(51) Int. Cl.
*G08B 21/00* (2006.01)

(52) U.S. Cl. ..... 340/635; 340/657

(58) Field of Classification Search ..... 340/635, 340/657

See application file for complete search history.

(56) References Cited

U.S. PATENT DOCUMENTS

| | | | | |
|---|---|---|---|---|
| 4,833,725 | A * | 5/1989 | Teetor | 455/67.13 |
| 5,543,779 | A * | 8/1996 | Aspesi et al. | 340/539.26 |
| 6,603,397 | B2 * | 8/2003 | Bronson | 340/540 |
| 7,158,769 | B2 * | 1/2007 | Okanoue et al. | 455/226.1 |
| 2002/0130774 | A1 * | 9/2002 | Bronson | 340/540 |
| 2002/0142744 | A1 * | 10/2002 | Okanoue et al. | 455/226.1 |
| 2003/0228846 | A1 * | 12/2003 | Berliner et al. | 455/67.11 |
| 2009/0219156 | A1 * | 9/2009 | August et al. | 340/572.1 |

FOREIGN PATENT DOCUMENTS

| | | |
|---|---|---|
| GB | 2426397 | 11/2006 |
| JP | 10048276 | 2/1998 |
| JP | 10232987 | 9/1998 |
| JP | 10267973 | 10/1998 |
| JP | 10320668 | 12/1998 |
| JP | 11068681 | 3/1999 |

OTHER PUBLICATIONS

Zetron, Inc., "Cell Phone Detector Plus", http://www.londoncomms.com/cellphone_detector.pdf, (Sep. 1998),1-2.

Hirata, et al., "Development of the EMI Detection Devices in the Aircraft", *Proceedings off Aircraft Symposium*vol. 39, No. S1p-453p. (2001),386-394.

Thermo Electron Corporation, "Next Generation Advanced Pocket-Size Radiation Meters", http://www.oconnors.wearnes.com/downloads/thermo_radeye.pdf. 1-4.

* cited by examiner

*Primary Examiner* — Travis Hunnings

(57) ABSTRACT

A system to reduce electromagnetic interference caused damage. The system includes a signal detector operably coupled to a wireless network. The system further includes a warning activator coupled to the signal detector. The warning activator activates a warning upon detection of a wireless signal in the network by the signal detector. The system further includes a warning apparatus coupled to the warning activator. The warning apparatus generates the warning in response to a detected wireless signal.

14 Claims, 5 Drawing Sheets

REDUCING HDD FAILURE CAUSED BY ELECTROMAGNETIC INTERFERENCE FROM WIRELESS DEVICES

TECHNICAL FIELD

The invention pertains to electromagnetic interferences and disk drives.

BACKGROUND ART

Direct access storage devices (DASD) are integral in everyday life, and as such, expectations and demands continually increase for greater speed for manipulating and for holding larger amounts of data. To meet these demands for increased performance, the mechano-electrical assembly in a DASD device, specifically the Hard Disk Drive (HDD) has evolved to meet these demands.

Many processes in the fabrication of an HDD are commonly performed in a "clean room" environment, e.g., being dust free, static and/or electromagnetic free, oxygen filtered, specific clothing requirements (clean room suits), and the like.

Many of the various persons and/or operators entering a clean room are inadvertently remiss in powering down/off their wireless communication device(s), e.g., cell phones, pagers, PDAs or other wirelessly configured portable computer system/device. Operable wireless communication devices have been observed to cause electro magnetic interference (EMI) induced damage during HDD fabrication.

SUMMARY OF THE INVENTION

A system and method for reducing electromagnetic interference caused hard disk drive failure is described.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

Reference will now be made in detail to embodiment(s) of the present invention. While the invention will be described in conjunction with the embodiment(s), it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, and components have not been described in detail as not to unnecessarily obscure aspects of the present invention.

Some portions of the detailed description, which follow, are presented in terms of procedures, steps, logic blocks, processing, and other symbolic representations of operations on data bits that can be performed by computer systems. These descriptions and representations are used by those skilled in the data processing arts to most effectively convey the substance of their work to others skilled in the art. A process, etc., is here, and generally, conceived to be a self-consistent sequence of operations or instructions leading to a desired result. The operations are those requiring physical manipulations of physical quantities. Usually, though not necessarily, those quantities take the form of electrical, electronic, magnetic, optical, and/or electro-optical signals, capable of being stored, transferred, combined, compared, and otherwise manipulated in a computer system. It has been proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities. Unless specifically stated otherwise, and as apparent from the following discussions, it is noted that throughout the present invention, the terms used herein refer to the action and processes of a computer system, or similar electronic computing device, that manipulates and transforms data represented as physical (electronic) quantities within the communications and computer systems' registers and memories into other data similarly represented as physical quantities within the computer system memories or registers or other such information storage, transmission, or display device.

Figure 4:
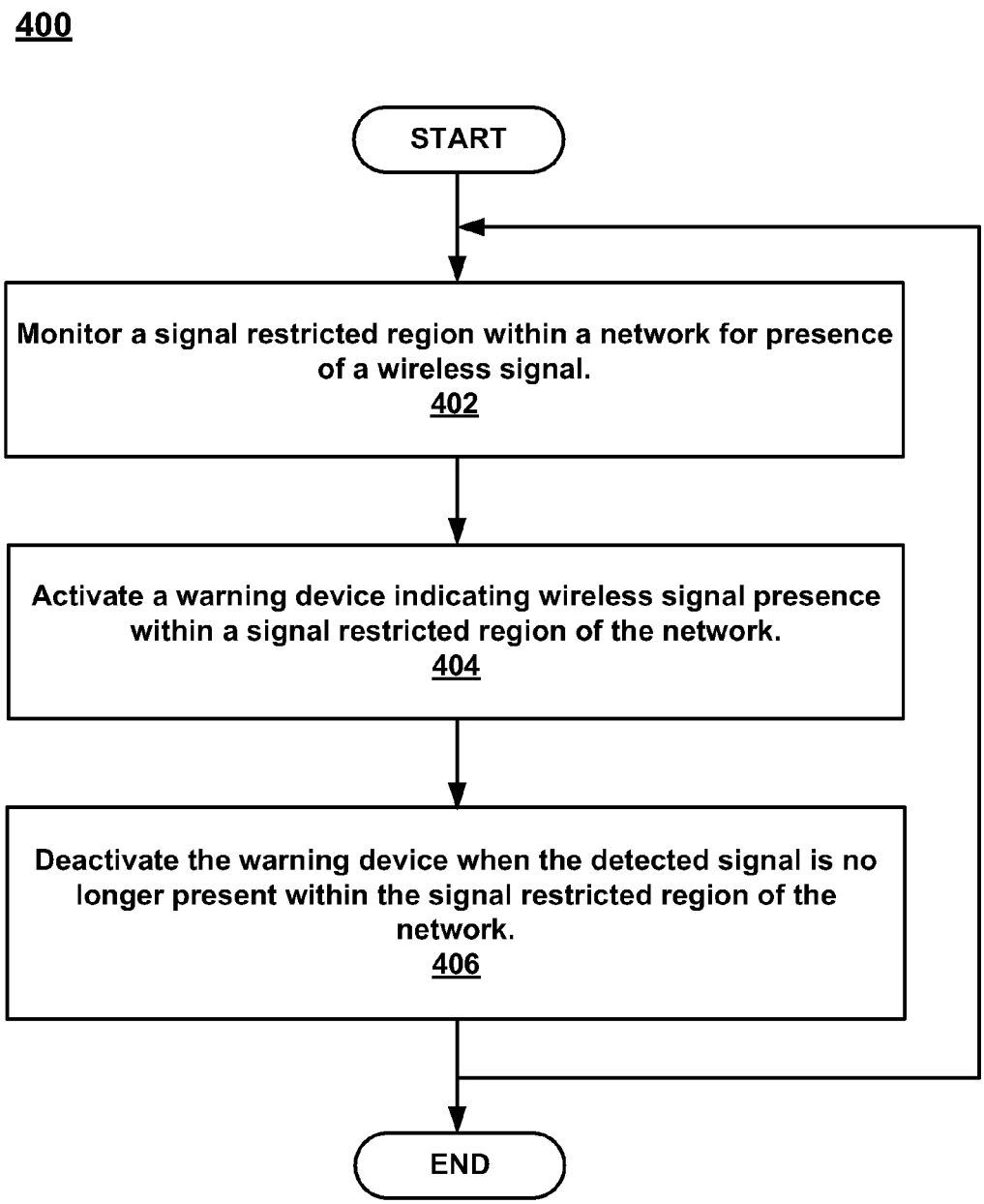
FIG. 4 is flowchart of a process for reducing electromagnetic interference induced hard disk drive damage, in accordance with an embodiment of the present invention.

Certain portions of the detailed description of embodiments the present invention, which follow, are presented in terms of processes (e.g., process 400 of FIG. 4). These processes are, in an embodiment of the present invention, carried out by processors and electrical and electronic components under the control of computer readable and computer executable instructions. The computer readable and computer executable instructions reside, for example, in registers and other features of processors, memories, and data storage features of computers executing programs and processes. However, the computer readable and computer executable instruction may reside in any type of computer readable medium. Although specific portions are disclosed in figures herein describing the operations of processes, e.g., FIG. 4; describing processes, e.g., process 400, such portions are exemplary. That is, the present invention is well suited to performing various others portions or variations of the portions recited in the flowchart of the figures herein. Further, it is appreciated that the steps of the processes may be performed by software, firmware, hardware, or any combination of software and firmware and hardware.

Overview

Figure 1:
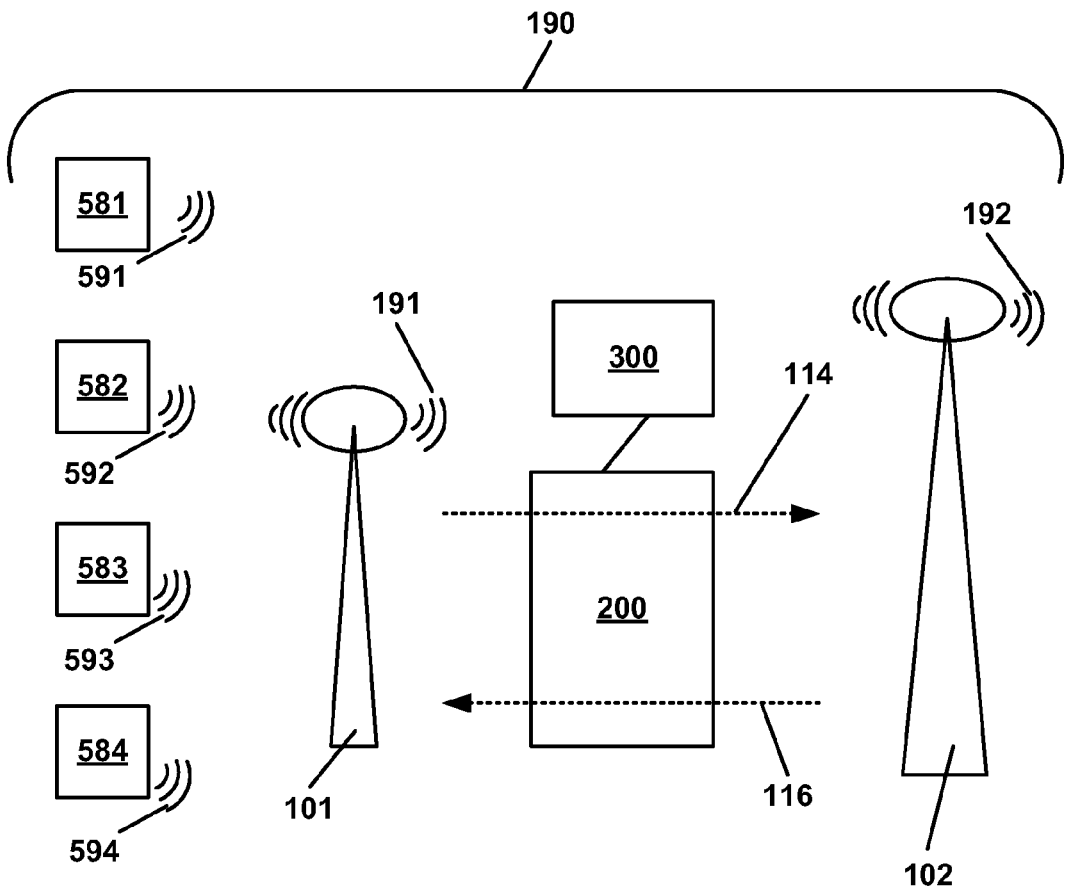
FIG. 1 is a block diagram of an environment for reducing electromagnetic interference caused hard disk drive failure in accordance with embodiments of the present invention.

With reference now to FIG. 1, a block diagram of an environment 100 for reducing electromagnetic interference (EMI) induced hard disk drive (HDD) damage is shown. Environment 100 is shown to include a network 190. Network 190 may be a wireless network, a wired network, or a combination wireless and wired network. In an embodiment of the present invention, network 190 may be a communication network located within a firewall of an organization or corporation (an "Intranet"), or network 190 may represent a portion of the World Wide Web or Internet. Portable computer devices 581, 582, 583 and 584 and system 300 are communicatively coupled via a communication line, in which the mechanisms for coupling computer systems over the Internet or over Intranets are well known in the art. This coupling can be accomplished over any network protocol, wired or wireless, that supports a network connection, such as IP (Internet Protocol), TCP (Transmission Control Protocol), UDP (User Datagram Protocol), TELNET, NetBIOS, IPX (Internet Packet Exchange), IR (infra red), RF (radio frequency), wireless broadband, Bluetooth, LU6.2, and link layers protocols such as Ethernet, token ring, and ATM (Asynchronous Transfer Mode). Alternatively, devices 581-584 and apparatus 300 may be coupled to network 190 via an input/output port (e.g., a serial port). It is noted that, for simplicity, four portable computer devices and a single system 300 are shown; however, it is understood that network 190 may comprise any number of portable computer devices and systems 300. In the present embodiment, network 190 is a combination network, exhibiting functional characteristics of both a wired and a wireless network.

In an embodiment of the present invention, environment 100 is shown to include a region 150 (indicated with a dotted line) upon which embodiments of the present invention are directed for reducing EMI induced HDD damage, in accordance with various embodiment of the present invention. Region 150 includes a transmission signal restricted area, e.g., clean room area 200, as described herein with reference to FIG. 2. In an embodiment of the present invention, area 200 may be a hard disk drive (HDD) fabrication/assembly/disassembly room. Region 150 further includes a system 300 for reducing electromagnetic interference induced damage that may be caused within area 200, in accordance with embodiments of the present invention, and as described in detail in FIG. 3. In an embodiment of the present invention, system 300 is operably coupled to area 200.

Still referring to FIG. 1, shown in network 190 are an antenna 101 and a base station 102. In an embodiment of the present invention, transmission signals, e.g., wireless communication signals, are sent (indicated by arrow 114) and received (indicated by arrow 116) between antenna 101 and base station 102 and wireless devices that may be connected to network 190. In an embodiment of the present invention, system 300 is configured to detect a transmission signal that may be generated by a wirelessly configured portable computer system, e.g., devices 581, 582 and 583.

Also shown is a short range wireless device 584 that, in an embodiment of the present invention, may be a Bluetooth device, e.g., a hands-free cell phone accessory, commonly used in and around the ear of a user of a device 581, 582 and/or 583. In an embodiment of the present invention, device 581 emits a signal 591, device 582 emits a signal 592, device 583 emits a signal 593, and device 584 emits a signal 594. In an embodiment of the present invention, devices 581, 582 and 583 may be, but are not limited to, a personal digital assistant (PDA), a cellular phone or a laptop computer system. Additionally, each device 581, 582 and 583 may include a device 584, enabling localized, e.g., Bluetooth, wireless communication.

Figure 2:
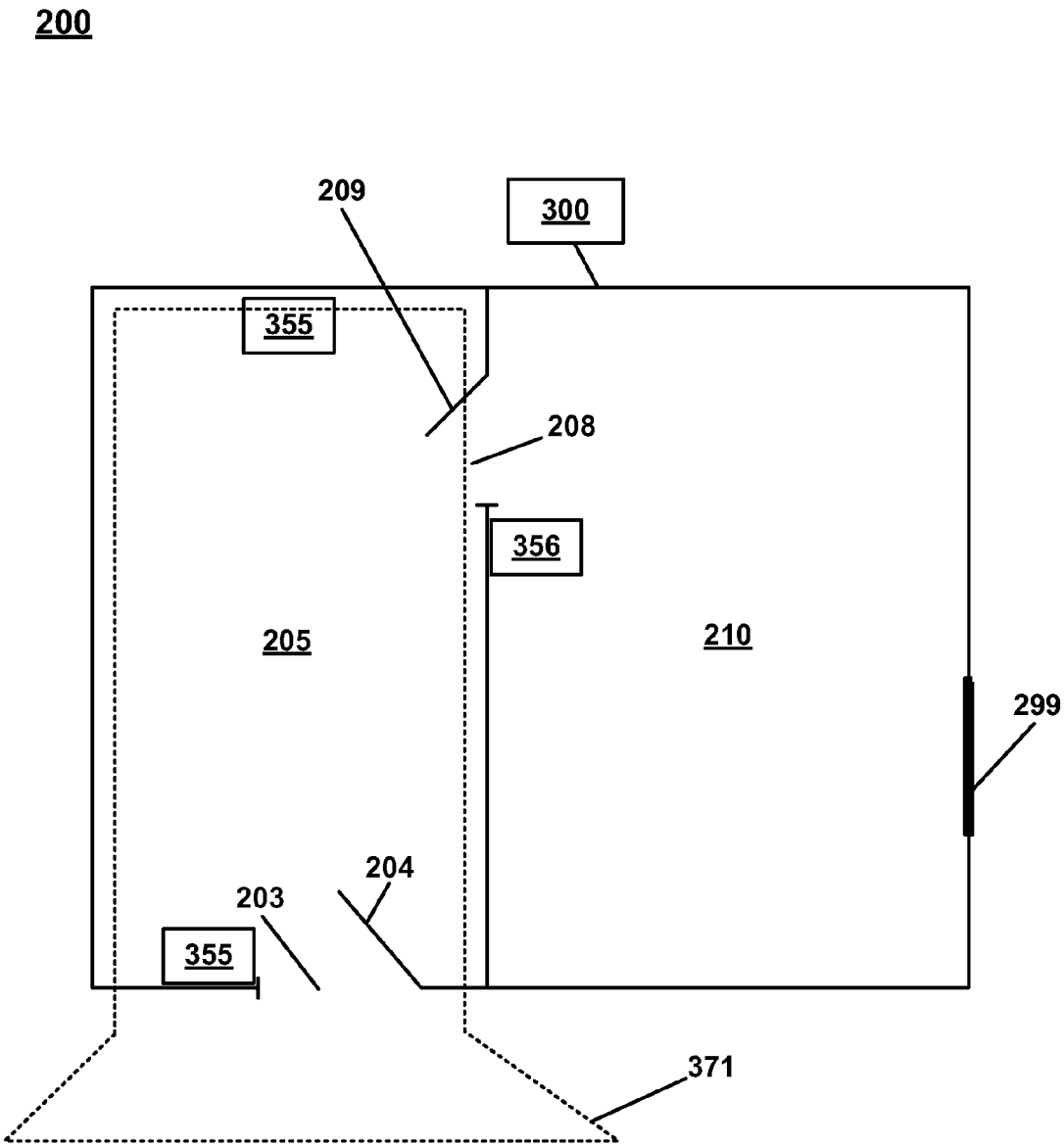
FIG. 2 is a block diagram of environment having an electromagnetic interference restricted region and upon which various embodiments of the present invention may be practiced, in an embodiment of the present invention.

FIG. 2 is an expanded block diagram view of area 200 of FIG. 1. Area 200 includes a signal detection portion 205 and a signal restricted portion 210, in an embodiment of the present invention. Area 200 includes a door 204 and an opening 203 enabling access to portion 205. Area 200 further includes a door 209 and an opening 208, disposed within portion 205, enabling access to portion 210. Area 200 may optionally include an emergency exit 299.

In an embodiment of the present invention, system 300 is configured to detect a wireless signal that may be present within a particular physical location of area 200. In the present embodiment, system 300 is shown configured for signal detection in monitoring region 371. In an embodiment of the present invention, monitoring region 371 monitors signal detection portion 205 and extends outside the confines of portion 205.

Figure 3:
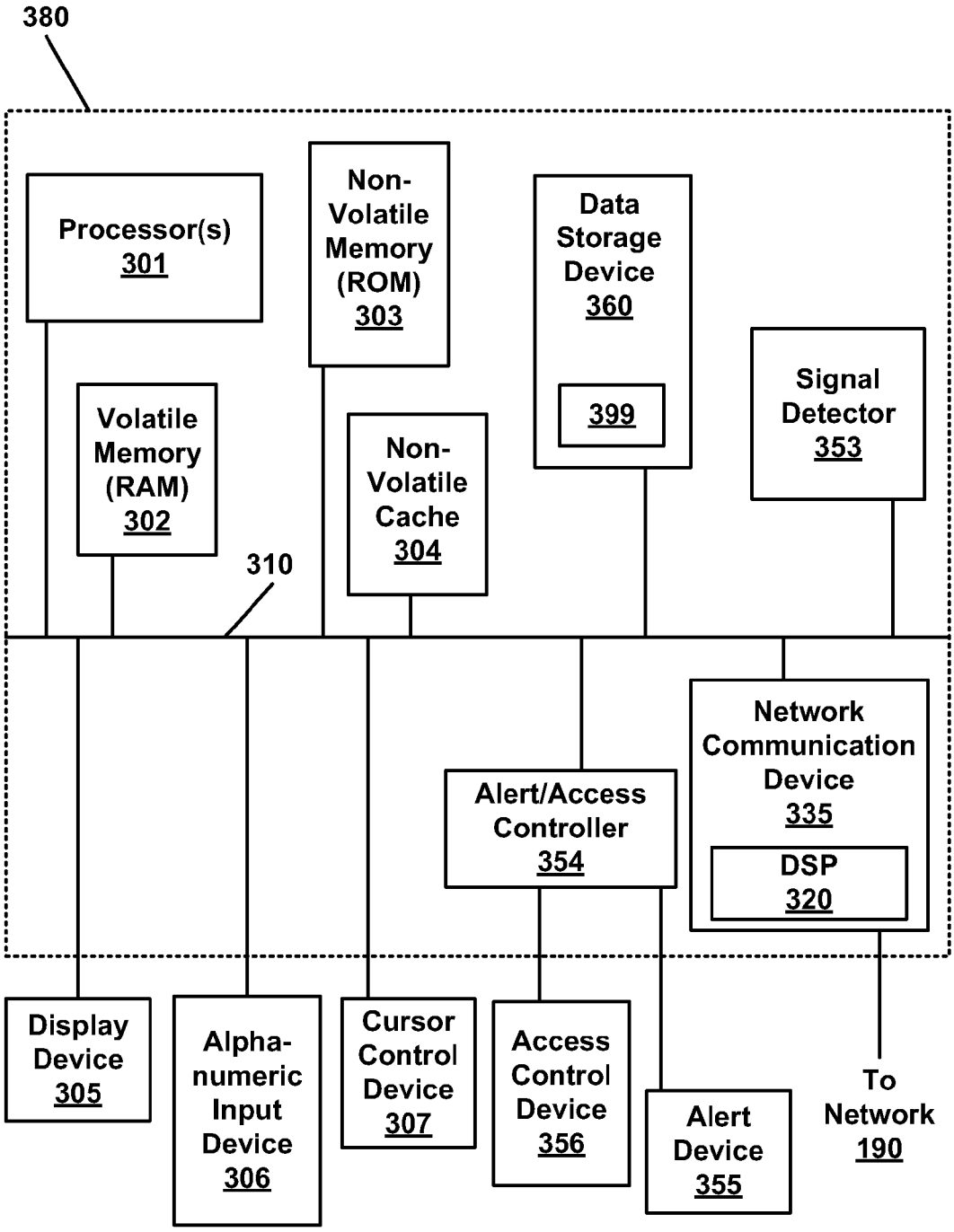
FIG. 3 is a block diagram of components in a system for reducing electromagnetic interference induced hard disk drive damage, in accordance with an embodiment of the present invention.

In an embodiment of the present invention, system 300 includes a detector 353 configured therewithin, as seen in FIG. 3. In an alternative embodiment of the present invention, detector 353 may be externally coupled to system 300, such that system 300 may be disposed elsewhere within network 190.

In accordance with an embodiment of the present invention, upon a portable computer device, e.g., device 581, 582, 583 and/or 584 entering signal restricted region 371, detector 353 detects the presence of a signal generated from the portable computer device. In accordance with embodiments of the present invention, detector 353 may activate an alert/access controller 354. Controller 354 may then activate an alert mechanism, e.g., alarm 355, to indicate the presence of a wireless signal within region 371, in an embodiment of the present invention. In an alternative embodiment of the present invention, controller 371 may activate an access control mechanism, e.g., access control mechanism 356, such that entering room 210 is prevented.

FIG. 3 is a block diagram illustrating components and circuitry of an exemplary computer system 380, which can be implemented as a system 300 as described herein with reference to FIGS. 1, 2 and 4, in accordance with embodiments of the present invention. Computer system 380 includes an address/data bus 310 for communicating information, a central processor 301 coupled with the bus for processing information and instructions, a volatile memory 302 (e.g., random access memory, RAM) coupled with the bus 310 for storing information and instructions for the central processor 301 and a non-volatile memory 303 (e.g., read only memory, ROM) coupled with the bus 310 for storing static information and instructions for the processor 301. Optionally, computer system 300 can include non-volatile cache 304 and dynamic ROM (DROM, not shown). It is noted that in an embodiment, computer system 380 can be configured with a plurality of processors 301.

Computer system 380 of FIG. 3 also includes a data storage device 360 coupled with bus 310 for storing instructions and information. In the present embodiment, data storage device 360 also includes a set of instructions 399 for monitoring a network for signals in a signal restricted area, e.g., area 200 of FIGS. 1 and 2, in accordance with an embodiment of the present invention. Instructions 399 enable computer system 380 to monitor a restricted signal region, e.g., region 371, for signal presence, in an embodiment of the present invention, and as described herein with reference to FIGS. 1-5.

It is noted that instructions 399 are shown stored within a data storage device, e.g., 360, in which data is stored in a relatively permanent environment. However, in an alternative embodiment, portions of instructions 399 may be combinationally distributed among non-volatile memory, e.g., ROM 303 and cache 304 and a data storage device 360. Data storage device 360 can be, for example, an HDD (hard disk drive), an FDD (floppy disk drive), a compact memory device, a CD-RW (compact disk with write functionality), a DVD-RW or DVD+RW (digital versatile disk with + or − write functionality), a dual layer DVD, a tape drive, a USB drive, etc., and furthermore device 360 can be in multiples or in a combination thereof. Data storage device 360 may also be local or remote to the computer system, plurally instanced, removable, and/or hot swappable (connected or unconnected while computer system is powered).

Computer system 380 is also shown to include a signal detector 353 coupled to bus 301, in an embodiment of the present invention. Detector 353 is configured to monitor a signal restricted region, e.g., region 371, within a wireless network, e.g., network 190, for the presence of a wireless signal, e.g., signals 591-594 generated by a portable computer device 581-584, respectively. In an embodiment of the present invention, upon detection of a wireless signal within region 371, instructions 399 may activate an alert/access controller, e.g., alert/access controller 354. In an embodiment of the present invention, upon activation, controller 354 may cause activation of an alerting device, e.g., alert device 355. In an embodiment of the present invention, alert device 355 may produce an audible sound to indicate the presence of a signal within signal restricted region 371. In another embodiment of the present invention, alert device 355 may produce a visible indicator to indicate the presence of a signal within signal restricted region 371.

In an embodiment of the present invention, controller 354 may be further configured to control access to the restricted area, e.g., clean room 210. In accordance with an embodiment of the present invention, controller 354 may interact with access control device 356 so to render door 209 inoperable, such that access to room 210 is prevented.

In accordance with various embodiments of the present invention, alert device 355 and/or access control device 356 may be deactivated upon removal of the detected signal, e.g., when the detected signal is removed from region 371 or when the device generating the detected signal is powered off.

With reference still to FIG. 3, computer system 380 also includes a network communication device 335, which is coupled to bus 310 for providing a communication link between computer system 300, and a network environment, e.g., network environment 150 of FIG. 1. As such, network communication device 335 enables central processor unit 301 to communicate with other electronic systems coupled to the network, e.g., network 150 of FIG. 1. It is noted that the present embodiment of network communication device 335 is well suited to be implemented in a wide variety of ways. In one example, network communication device 335 is coupled to an antenna and provides the functionality to transmit and receive information over a wireless communication interface, e.g., Bluetooth, IR (infra-red), RF (radio frequency), satellite and the like. In another example, network communication device 335 could be implemented as a modem, wired or wireless. In yet another example, network communication device 335 could be configured as a NIC (network interface card), wired or wireless.

Still referring to FIG. 3, network communication device 335, in an embodiment, includes an optional digital signal processor (DSP) 320 for processing data to be transmitted or data that are received via network communication device 335. Alternatively, processor 301 can perform some or all of the functions performed by DSP 320.

Also included in computer system 380 of FIG. 3 is an optional alphanumeric input device 306. In an implementation, device 306 is a keyboard. Device 306 can be physically coupled to computer system 380. Alternatively, device 306 may be wirelessly coupled to computer system 380. Alphanumeric input device 306 can communicate information and command selections to processor 301.

System 380 of FIG. 3 also includes an optional cursor control or directing device (on-screen cursor control) 307 coupled to bus 310 for communicating user input information and command selections to processor 301. In another common implementation, on-screen cursor control device 307 is a mouse or similar pointing device.

System 380 also contains a display device 305 coupled to the bus 310 for displaying information to the computer user.

Although embodiments of the present invention are shown implemented in a disk drive 111 that is configured with four hard disks and three actuator arm assemblies, it is noted that embodiments of the present invention are well suited for utilization in hard disk drives with a greater number or lesser number of hard disks as well as hard disk drives having a greater number or lesser number of actuator arm assemblies. As such, hard disk drives shown and described herein, and upon which embodiments of the present invention may be practiced, are exemplary in nature are not to be construed as a limitation.

FIG. 4 is a flowchart of a process 400 for maintaining a servo signal in accordance with various embodiments of the invention. Process 400 includes exemplary operations of various embodiments of the invention which can be carried out by a processor(s) and electrical components under the control of computing device readable and executable instructions (or code), e.g., instructions 399. The computing device readable and executable instructions (or code) may reside, for example, in data storage features such as volatile memory, non-volatile memory and/or mass data storage that are usable by a computing device. However, the computing device readable and executable instructions (or code) may reside in any type of computing device readable medium. Although specific operations are disclosed in process 400, such operations are exemplary. That is, process 400 may not include all of the operations illustrated by FIG. 5. Also, process 400 may include various other operations and/or variations of the operations shown by FIG. 4. Likewise, the sequence of the operations of process 400 can be modified. It is noted that the operations of process 400 can be performed by software, by firmware, by hardware, or by any combination thereof.

Process 400 for reducing electromagnetic interference caused damage will be described with reference to components and devices shown in FIGS. 1-3, and FIG. 5, in accordance with embodiments of the present invention.

Figure 5:
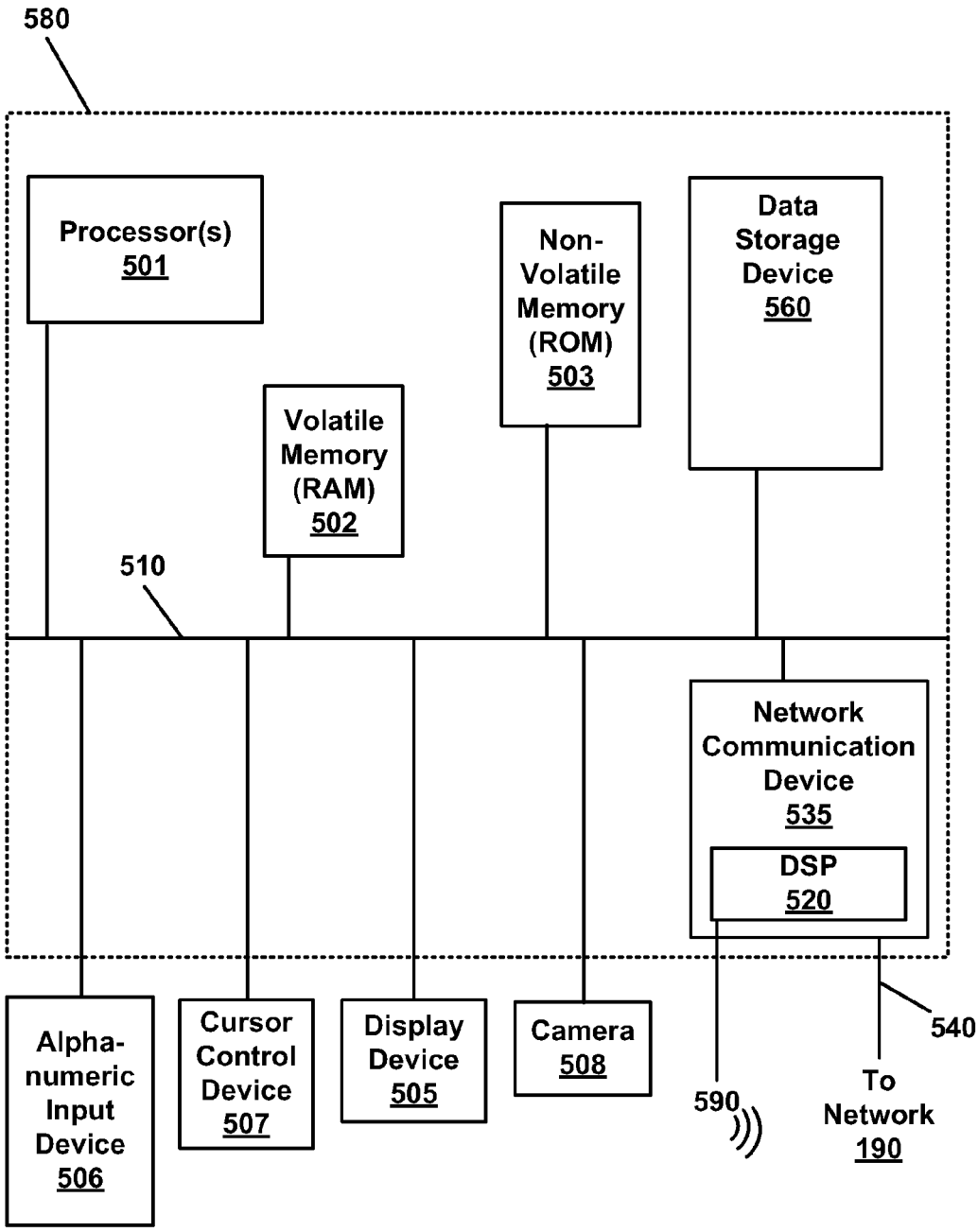
FIG. 5 is a block diagram of components of an exemplary wireless device upon which embodiments of the present invention may be practiced, in accordance with embodiments of the present invention.

In operation 402 of process 400, a signal restricted area, e.g., region 371 of area 200 is monitored for the presence of a signal that may be generated by a portable computer device, e.g., portable computer devices 581-584 of FIG. 1 and FIG. 5. In an embodiment of the present invention signal detector 353 monitors region 371 for wireless signal presence. If a powered on portable computer device, e.g., 591-594 of FIG. 1, enters region 371, signal detector 353 detects the signal generated thereby. In an embodiment of the present invention, opening of door 204 may activate operation of signal detector 353.

In operation 404 of process 400, upon detection of a portable computer system signal in region 371, e.g., signals 591-594, by signal detector 353, detector 353 activates an alert/access controller, e.g., controller 354. In accordance with an embodiment of the present invention, controller 354 may activate alarm 355, indicating presence of a signal in signal restricted region 371. In another embodiment of the present invention, controller 354 may activate access control device 356 so as to control operation of door 209, such that door 209 is not operational, such that access to room 210 is prevented.

In process 406 of process 400, once the detected signal is no longer present within signal restricted region 371, e.g., by either removing the portable computer device from the signal restricted region or by powering down the portable device, controller 354 deactivates the alerting mechanism, e.g., alarm 355 or access control device 356. If continued monitoring of a signal restricted region is warranted, process 400 returns to operation 402. It is noted that subsequent to completion of operation 406, process 400 may be also terminated.

It is noted that although various embodiments of the present invention are shown implemented in a hard disk drive fabrication environment, e.g., area 200, embodiments of the present invention are well suited to be implemented in alternative environments. For example, embodiments of the present invention may be implemented in a public transportation facility, e.g., an airport, in which area 150 may be a boarding gate, opening 203 may be a door proximal to the boarding gate and opening 208 may be the entrance to an airplane. In another example, embodiments of the present invention may be implemented in a health care facility, e.g., a hospital, in which area 150 may be, but is not limited to, a surgical environment having a pre-operative region 205 and an operating region 210. In yet another example, area 150 may be forensics laboratory. In each example, embodiments of the present invention may be configured to provide detection of a wireless signal, thus preventing the introduction of electromagnetic interference within a signal restricted region.

FIG. 5 is a block diagram illustrating components and circuitry of an exemplary portable computer system 580, upon which various embodiments of the present invention may be practiced. Portable computer system 580 can be implemented as, but is not limited to, a cellular phone, a personal digital assistant, a laptop computer system, etc. It is noted that portable devices 581, 582, 583 and 584 may each implemented with some or all of the components and circuitry of portable computer system 580.

Portable computer system 580 includes an address/data bus 510 for communicating information, a central processor 501 coupled with the bus for processing information and instructions, a volatile memory 502 (e.g., random access memory, RAM) coupled with the bus 510 for storing information and instructions for the central processor 501 and a non-volatile memory 503 (e.g., read only memory, ROM) coupled with the bus 510 for storing static information and instructions for the processor 401. Optionally, portable computer system 580 can include dynamic ROM (DROM, not shown). It is noted that in an embodiment, portable computer system 580 can be configured with a plurality of processors 501.

Portable computer system 580 of FIG. 5 also includes a data storage device 560 coupled with bus 510 for storing instructions and information. Data storage device 560 can be, for example, an HDD (hard disk drive), an FDD (floppy disk drive), a compact memory device, a CD-RW (compact disk with write functionality), a DVD-RW or DVD+RW (digital versatile disk with + or − write functionality), a dual layer DVD, a tape drive, a USB drive, etc., and furthermore device 560 may be implemented in multiples or in a combination thereof within portable computer system 580. Data storage device 560 may also be local or remote to the computer system, plurally instanced, removable, and/or hot swappable (connected or unconnected while computer system is powered).

With reference still to FIG. 5, device 580 includes a network communication device 535, which is coupled to bus 510 for providing a communication link between device 580, and a network environment, e.g., network environment 190 of FIG. 1. As such, network communication device 535 enables central processor unit 501 to communicate with other electronic systems coupled to the network, e.g., network 190 of FIG. 1. It is noted that the present embodiment of network communication device 535 is well suited to be implemented in a wide variety of ways.

In one example, network communication device 535 is coupled to an antenna and provides the functionality to transmit and receive information over a wireless communication interface 590, e.g., Bluetooth, IR (infra-red), RF (radio frequency), satellite and the like. In another example, network communication device 535 could be implemented as a modem, e.g., a wired connection 540 or a wireless connection 590. In yet another example, network communication device 535 could be configured as a NIC (network interface card), having wired (540) or wireless (590) connectivity to network 190.

It is noted that portable computer system 580, when configured with a network communication device 535 having wireless connective functionality produces a signal containing a frequency energy while powered on, in a manner mode (e.g., on vibrate), on standby, or in any other mode in which a signal is generated by device 535. It is upon device 535 generated signals that various embodiments of the present invention are directed.

Still referring to FIG. 5, network communication device 535, in an embodiment, includes an optional digital signal processor (DSP) 520 for processing data to be transmitted or data that are received via network communication device 535. Alternatively, processor 501 can perform some or all of the functions performed by DSP 520.

Also included in portable computer system 580 of FIG. 5 is an optional alphanumeric input device 506. In an implementation, device 406 is a keyboard. Device 506 can be integrated within the form factor of portable computer system 480. Device 506 can be physically coupled to portable computer system 480. Alternatively, device 506 may be wirelessly coupled to portable computer system 480. Alphanumeric input device 506 can communicate information and command selections to processor 501.

Portable computer system 580 of FIG. 5 may also include an optional cursor control or directing device (on-screen cursor control) 507 coupled to bus 510 for communicating user input information and command selections to processor 501. In another common implementation, on-screen cursor control device 507 is a mouse or similar pointing device.

Portable computer system 580 also contains a display device 505 coupled to the bus 410 for displaying information to the computer user. Portable computer system may also contain a camera 508 for capturing images.

Accordingly, embodiments of the present invention, as described herein with reference to FIGS. 1-5 can be utilized to reduce electromagnetic interference induced damage, in accordance with embodiments of the present invention.

Embodiments of the present invention, in the various presented embodiments, provide reduced electromagnetic interference caused damage in an electromagnetic interference restricted environment.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments described herein were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A system to reduce electromagnetic interference caused damage in a hard disk drive, comprising:

a signal detector operably coupled to a wireless network for a predetermined area around a specific region within which a wireless signal emanating from a wireless device is restricted;

a warning activator coupled to said signal detector, said warning activator to activate an audio/visual warning upon detection of said wireless signal emanating from a wireless device within said predetermined area around said specific region;

an access preventor coupled to said warning activator, said access preventor to deny access to said specific region in response to said detection of said wireless signal emanating from the wireless device within the predetermined area around said specific region; and a warning deactivator coupled to said signal detector, said warning deactivator to automatically deactivate said audio/visual warning and to automatically restore access to said specific region after said wireless signal is deactivated such that the wireless signal is no longer emanating from the wireless device within the predetermined area around the specific region.

2. The system as recited in claim 1 wherein said signal detector detects an active wireless signal.

3. The system as recited in claim 1 wherein said signal detector detects an inactive wireless signal.

4. The system as recited in claim 1 wherein said warning further comprises:

an audible warning generated in response to said detected wireless signal.

5. The system as recited in claim 1 wherein said warning further comprises:

a visible warning generated in response to said detected wireless signal.

6. A system for reducing instances of electromagnetic interference caused damage in a hard disk drive, comprising:

means for detection of a wireless network signal for a predetermined area around a restricted wireless signal area within which a wireless signal emanating from a wireless device is restricted;

means for activation of a wireless signal detection indicator, said means for activation of a wireless signal detection indicator coupled with said means for detection of a signal, said wireless signal detection indicator activated in response to said means for detection of a signal detecting said wireless signal emanating from the wireless device within the predetermined area around said restricted wireless signal area;

a means to deny access to said restricted wireless signal area in response to said detection of said wireless signal emanating from the wireless device within the predetermined area around said restricted wireless signal area; and a means to automatically deactivate said wireless signal detection indicator and to automatically restore access to said restricted wireless signal area after said wireless signal is deactivated such that the wireless signal is no longer emanating from the wireless device within the predetermined area around the restricted wireless signal area.

7. The system as recited in claim 6 further comprising:

means for generating said wireless signal detection indicator, said means for generating said wireless signal detection indicator coupled with said means for activation of said wireless signal detection indicator.

8. The system as recited in claim 7 wherein said wireless signal detection indicator further comprises:

means for generating an audible wireless signal detection indicator.

9. The system as recited in claim 7 wherein in said wireless signal detection indicator further comprises:

means for generating a visible wireless signal detection indicator.

10. The system as recited in claim 6 wherein said means for detecting a signal further comprises:

means for detecting an active wireless signal; and means for detecting an inactive wireless signal.

11. A method for reducing instances of electromagnetic interference caused damage in a hard disk drive, comprising:

monitoring a predetermined area around a wireless signal restricted region in a wireless network for presence of a wireless signal emanating from a wireless device;

generating an audio/visual wireless signal presence indicator upon detection of said wireless signal emanating from the wireless device within the predetermined area around said wireless signal restricted region;

denying access to said wireless signal restricted region upon detection of said wireless signal emanating from the wireless device within the predetermined area around said wireless signal restricted region; and automatically deactivating said audio/visual wireless signal presence indicator and automatically restoring access to said wireless signal restricted region after said wireless signal is deactivated such that the wireless signal is no longer emanating from the wireless device within the predetermined area around the wireless signal restricted region.

12. The method as recited in claim 11 wherein said monitoring further comprises:

monitoring said wireless signal restricted region for an inactive wireless signal.

13. The method as recited in claim 11 wherein said generating further comprises:

activating an audible said wireless signal presence indicator.

14. The method as recited in claim 11 wherein said generating further comprises:

activating a visible said wireless signal presence indicator.

* * * * *